United States Patent [19]

Firey

[11] 4,077,381

[45] Mar. 7, 1978

[54] GASOLINE ENGINE FUEL INTERRUPTER

[76] Inventor: Joseph Carl Firey, 1544 NE. 95th St., Seattle, Wash. 98115

[21] Appl. No.: 709,621

[22] Filed: Jul. 28, 1976

Related U.S. Application Data

[63] Continuation-in-part of Ser. No. 330,968, Feb. 9, 1973, abandoned.

[51] Int. Cl.[2] ..... F02N 17/00; F02B 77/00

[52] U.S. Cl. ..... 123/179 G; 123/179 L; 123/198 D; 123/198 DB

[58] Field of Search ..... 123/179 G, 179 R, 179 BG, 123/198 D, 198 DB, 179 L

[56] References Cited

U.S. PATENT DOCUMENTS

| | | | |
|---|---|---|---|
| 3,763,397 | 10/1973 | Yockers | 123/198 D |
| 3,897,771 | 8/1975 | Stumpp | 123/198 DB |
| 3,916,865 | 11/1975 | Kiencke | 123/198 DB |
| 3,973,539 | 8/1976 | Jones | 123/198 DB |
| 3,977,384 | 8/1976 | Jahn | 123/198 DB |
| 3,993,038 | 11/1976 | Alt | 123/179 G |

*Primary Examiner*—Ronald H. Lazarus
*Assistant Examiner*—Daniel J. O'Connor

[57] ABSTRACT

This invention provides means for stopping the flow of gasoline through a gasoline engine during the initiation of starting. In this way the engine contribution of smog forming materials is reduced and the engine is more easily started. This improved starting of the engine is achieved by increasing the portion of the work of compression available to usefully evaporate gasoline. To accomplish these results a stop valve is interposed between the fuel metering system and the fuel delivery jet of the engine carburetor, the valve being so automatically actuated so as to open only after a delay time interval of engine cranking during cold starting. The valve may also be closed automatically whenever the engine ignition is turned off thus assuring a prompt stopping of the engine.

4 Claims, 4 Drawing Figures

GASOLINE ENGINE FUEL INTERRUPTER

This application is a continuation-in-part of my earlier application, "Gasoline Engine Stop Valve," Ser. No. 330,968, filing date Feb. 9, 1973 now abandoned.

CROSS REFERENCE TO RELATED APPLICATIONS

Some of the objects of this invention are the same as the objects of the invention described in U.S. Pat. No. 3,732,856 and the invention described herein accomplishes these objects in an improved manner.

BACKGROUND OF THE INVENTION

1. Field of the Invention

This invention is in the field of gasoline engines and specifically in the field of improvements in the cold starting and hot stopping of gasoline engines.

2. Description of the Prior Art

When a gasoline engine is to be started cold, gasoline, considerably in excess of that needed to create a spark ignitable air-fuel vapor mixture, is mixed with the incoming air in the carburetor because only a small portion of the liquid gasoline evaporates when the engine is cold, and it is only the evaporated gasoline portions which mix with the air to form the ignitable air-fuel vapor mixture. To evaporate liquid gasoline requires that heat be transferred to the gasoline at least equal to the latent heat of evaporation of those gasoline portions evaporating. In a cold engine, which is not firing, the only static sources of the heat energy needed for gasoline evaporation are, the metal of the carburetor, manifolds, valves, cylinders, and pistons of the engine, the incoming air, and the unevaporated gasoline portions. When the ambient air temperature, and hence the engine metal temperatures, are warm enough that these static heat energy sources can evaporate sufficient of the liquid gasoline to create an ignitable air-fuel vapor mixture the engine will start upon the first pair of cranking revolutions. At air temperatures below this "warm start" temperature the engine does not start upon the first pair of cranking revolutions and the gasoline evaporated during such non-firing cranking revolutions is pumped out the engine exhaust valve and discharged into the atmosphere as unburned hydrocarbons. In addition the heat energy extracted statically from the metal parts of the engine to evaporate these discharged unburned hydrocarbons is also thrown away and the temperature of these metal parts is reduced thereby. Hence during subsequent, non-firing cranking revolutions less heat is available for gasoline evaporation and less liquid gasoline is evaporated from these static sources and, if heat energy for evaporation were available only from these static sources a gasoline engine would either start firing on the first pair of cranking revolutions or it would not start firing on any of the subsequent cranking revolutions. Experience shows, however, that a cold engine can be started by prolonged cranking and that the number of cranking revolutions needed to start the engine firing generally increases as the engine is colder, as shown, for example, in the article entitled, "Effect of Fuel Volatility on Starting and Warm-up of New Automobiles," by Messrs. Moore, Young and Toulmin, Transactions of the Society of Automotive engineers, Volume 65, p. 692, 1957. During the non-firing cranking revolutions the electric starter motor overcomes engine friction forces and compresses and expands the air-fuel vapor mixture. The work of compressing the air-fuel vapor mixture increases its temperature above the value prevailing in the engine intake manifold, the maximum rise in temperature occurring when maximum compression pressure is attained. Thereafter during expansion the temperature of the air-fuel vapor mixture decreases from this maximum attained value and would again reach the value prevailing in the engine intake manifold if no liquid gasoline evaporation occurred and if no heat transfer took place between the air-fuel vapor mixture and the adjacent, colder engine parts (piston, cylinder, valves, etc.). Hence, in general, the air-fuel vapor mixture is hotter than the adjacent engine parts throughout most of the compression and expansion processes and, in consequence, heat energy is transferred from this hotter air-fuel vapor mixture to the adjacent colder piston, cylinder wall, cylinder head, valves, etc. causing an increase in the temperature of these engine parts. That portion of the cranking work of the electric starter motor devoted to overcoming the friction force between the cylinder wall and the piston and rings reappears as increased energy content and hence increased temperature of these engine parts. This "dynamic" source of heat energy from the engine cranking work of the electric starter motor can evaporate additional portions of liquid gasoline and, when a sufficient quantity of this dynamic heat energy has been stored, by continued cranking, in the internal metal surfaces of the engine combustion chamber, sufficient additional gasoline is evaporated to create an ignitable air-fuel vapor mixture and the engine may then start firing. We may now define a "cold" start of a gasoline engine as a start wherein the dynamic heat energy thus stored during cranking is required to cause sufficient additional gasoline evaporation that an ignitable mixture is created and the engine starts firing. The devices of this invention function to improve the starting of gasoline engines under "cold" starting conditions as thus defined.

Whenever gasoline is evaporated during a cranking revolution without the engine having started firing in consequence, not only is the thusly evaporated gasoline discarded into the exhaust manifold and thereafter useless for the starting of the engine, but additional detriment to starting results from the corresponding heat energy, from both static and dynamic sources, being also discarded and being thereafter unavailable to aid in starting the engine on subsequent cranking revolutions. It is thus seen that a better way to cold start a gasoline engine is to crank the engine, without gasoline admission, until a sufficiently high temperature of the internal metal surfaces of the engine combustion chamber is reached that, when gasoline is admitted, enough evaporates to create an ignitable air-fuel vapor mixture and in consequence the engine commences firing immediately upon the admission of gasoline. In this way the amount of gasoline needed for cold starting can be reduced and the duration of cranking required to start the engine is reduced. It is an object of this invention to automatically accomplish this improved manner of cold starting gasoline engines.

The engine choke acts to supply the excess gasoline needed for cold starting by restricting incoming air flow upstream of the carburetor and in this way increasing the pressure difference between the carburetor float bowl and the air flowing through the venturi and in consequence a greater quantity of gasoline flows through the carburetor jets into the incoming air. The amount of excess gasoline thus metered into the air increases as the choke is set more nearly closed. At wide open choke, no excess gasoline is metered. Hence, the quantity of excess gasoline metered during cold starting is controlled by controlling the choke. The invention described in U.S. Pat. No. 3,732,856 accomplishes the cold starting objects described herein above by automatically holding the choke wide open, and hence inoperative, during the early period of cranking and then allowing the choke to close after the cranking work has sufficiently increased the temperatures of various interior engine surfaces that the excess gasoline, admitted upon choke closure, is adequately evaporated to produce an ignitable air-fuel vapor mixture immediately or shortly after closing the choke. In this way the excess gasoline flow caused by the choke is withheld from the engine until it is ready to start. The invention described herein accomplishes the cold starting objects described herein in an improved manner by not only withholding the excess gasoline flow caused by the choke but also by withholding any gasoline flow through the gasoline metering device and delivery jets since the gasoline flow passage is altogether closed by the valve portion of the devices of this invention.

Many gasoline engines do not stop running when the ignition is turned off because an ignition source, other than the electric spark, exists somewhere in the engine combustion chamber. Frequently this extra source of ignition is a hot portion of the combustion chamber surface such as the ceramic insulator of the spark plug, the engine exhaust valve head, deposits formed on the combustion chamber surface from portions of the fuel and lubricating oil used in the engine. In some cases this extra source of ignition may be compression ignition occurring at low engine speed. Whatever the source of this extra ignition it prevents the prompt stopping of the engine when desired which is not only inconvenient but may also be hazardous at times. Additionally this running-on of the engine after the electric spark has been turned off may contribute additional unburned hydrocarbons as smog materials into the atmosphere. Commonly, only a few of the cylinders of a multicylinder engine continue to fire after the electric spark has been turned off and the gasoline in the non-firing cylinders is discharged as unburned hydrocarbons to the engine exhaust. By fully stopping the flow of gasoline to the engine at the time the electric spark ignition is turned off the prompt stopping of the engine is assured, no matter what extra sources of ignition there may be, and no additional unburned hydrocarbons are discharged into the atmosphere. This invention accomplishes this stoppage of gasoline flow by closure of the valve element at ignition turn off as described previously herein, and, in this manner, accomplishes these additional beneficial objects relating to the stopping of the engine.

SUMMARY OF THE INVENTION

It is an object of this invention to provide improved means for reducing the amount of excess gasoline passed through a gasoline engine during starting. In this way the contribution of smog forming materials to the atmosphere is reduced, the net consumption of gasoline by the engine is reduced and the starting of the engine is rendered easier. An additional object of this invention is to provide means for stopping the flow of gasoline to the engine when the engine ignition system is turned off in order to prevent "running-on" of the engine due to non-spark ignition. In this way the contribution of smog forming materials to the atmosphere is further reduced and the stopping of the engine is assured whenever the engine ignition is turned off. The several forms of this invention are devices comprising a valve, a valve actuator and a timer component. The valve is interposed between the fuel metering device and the fuel delivery jet of the gasoline metering system of a gasoline engine so that fuel flow is stopped when the valve is closed. The valve actuator automatically operates the valve so that it is closed at the initiation of the cranking of the engine for cold starting and is subsequently opened, after a delay time interval of engine cranking, to admit gasoline to the engine for starting. A lubricating oil pressure actuated switch may also be used to automatically close the valve and stop fuel flow when the engine ignition system is turned off thus insuring that the engine will stop running. The timer component automatically sets into the actuator the delay time interval of engine cranking which intervenes between the initiation of the cranking of the engine for starting and the opening of the valve. The valve element can be any one of several different types providing only that the valve can close fully and open fully. Various kinds of actuators may be used such as a solenoid powered from the battery via the ignition circuit. Various kinds of timers may be used such as electrically heated thermostatic switches for solenoid actuators. It is a further object of this invention to accomplish the foregoing beneficial objects automatically and with relatively inexpensive devices.

The several beneficial objects of this invention may be accomplished by use of the gasoline engine fuel interrupter devices set forth in greater detail in the following descriptions of the invention and claims.

BRIEF DESCRIPTION OF THE DRAWINGS

One preferred form of the invention is shown diagrammatically in FIGS. 1, 2, 3 and 4 wherein.

DESCRIPTION OF PREFERRED EMBODIMENTS

Figure 1:
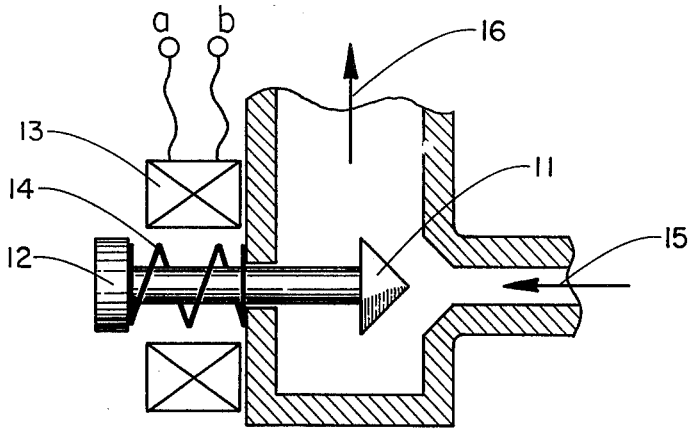
FIG. 1 is a cross sectional view of one form of gasoline stop valve element, 11, actuated by the solenoid, 13, and connecting at 15 to the fuel metering element of the gasoline engine and connecting at 16 to the fuel delivery jet of the gasoline engine.

The apparatus of this invention is used in combination with a conventional gasoline engine and is introduced, as described in detail herein, in combination with the gasoline metering system of said gasoline engine. The term "conventional gasoline engine" is used hereinafter and in the claims to mean the known and conventional combinations of cylinders, cylinder heads, pistons operative within said cylinders and connected to a crankshaft via connecting rods, valves and valve actuating means or cylinder ports, cooling system, ignition system and ignition switch, flywheels, starting system with starting battery and starting switch, fuel supply system, fuel-air mixing system, intake pipes and exhaust pipes, torque control system, lubrication system including an oil pump and lubricating oil pressure supply system, etc. as necessary for the proper operation of said conventional gasoline engine. The term "conventional gasoline engine" is used hereinafter and in the claims to include also the known and conventional combinations as described above but wherein the cylinders, cylinder heads, pistons operative within said cylinders and connected to a crankshaft via connecting rods, valves and valve actuating means or cylinder ports, are replaced by a rotary engine mechanism combination comprising a housing with a cavity therein, and plates to enclose the cavity, a rotor operative within said cavity and sealing off separate compartments within said cavity and connecting directly or by gears to an output shaft, ports in said housing for intake and exhaust.

Most gasoline engines today use a carburetor to meter the gasoline to the engine and a choke plate is added at the inlet to the carburetor, and is positioned via the choke actuating lever attached thereto, to act as a starting mixture enrichener to enrichen the air-fuel mixture going to the engine by supplying excess gasoline in order that the engine may start firing when cold. Some gasoline engines use fuel injection systems to meter the gasoline to the engine. Several different types of fuel injection systems are used, each equipped with a starting mixture enrichener, the equivalent of a choke, to supply the excess gasoline needed to enrichen the mixture for cold starting. The terms choke and choke plate are used in the description and claims of this invention to mean any starting mixture enrichener as used on an engine gasoline metering system. The term carburetor is used in the description and claims of this invention to mean any engine gasoline metering system. Gasoline metering systems of both the carburetor and fuel injection type comprise a fuel metering device to properly measure out the fuel quantity in proportion to air flow to the engine and a fuel delivery jet which sprays the liquid gasoline into the air quantity with which this gasoline is to burn.

The several forms of this invention are devices comprising a valve, a valve actuator and a timer component. The valve is interposed between the fuel metering device and the fuel delivery jet of the gasoline metering system of a gasoline engine so that fuel flow to the engine is stopped when the valve is closed. In those gasoline metering systems wherein the fuel delivery jet constitutes a portion of the fuel metering device the valve is placed before the fuel delivery jet in the flow direction so as to be able to stop the flow of fuel to the engine when closed. A lubricating oil pressure actuated switch may be used to automatically operate the valve so that it closes and stops fuel flow, when the engine ignition system is turned off thus insuring that the engine will stop even though an ignition source other than the electric spark may exist in the engine combustion chamber. The valve actuator automatically operates the valve so that it is closed at the initiation of the cranking of the engine for cold starting and is subsequently opened, after a delay time interval of engine cranking, the gasoline metering system then becoming operative to supply gasoline to the engine in order that the engine may start firing. By thus withholding the supply of gasoline from the engine, during the first portion of cranking, the temperature of the internal surfaces of the engine combustion chamber can rise more rapidly than would be possible if gasoline were admitted. The cold engine cannot start until these internal engine surfaces have experienced a certain required magnitude of temperature increase due to cranking and the quickest start will be obtained by so conducting the cranking that the rate of this temperature increase is maximized. The devices of this invention fully withhold the supply of gasoline from the engine and thus maximize the rate of temperature increase of the internal surfaces of the engine combustion chamber. It is in this way that the devices of this invention make it possible for a cold gasoline engine to start more quickly; they withhold all gasoline until the temperature rise of the internal surfaces is adequate to insure starting directly upon the admission of the gasoline. Not only is a quicker start obtained with the devices of this invention but no gasoline is pumped through the engine until it is ready to start and the smog contribution of the engine is thereby reduced. The timer component automatically sets into the actuator the delay time interval of engine cranking which intervenes between the initiation of the cranking of the engine for starting and the opening of the valve to admit gasoline to the engine. The preferred forms of timer component set the delay time interval longer when the ambient air temperature decreases since a longer time of cranking is needed to increase the temperature of the internal engine surfaces up to the point where starting can occur when the engine is colder.

In thus improving the cold starting of gasoline engines this invention is performing in an improved way a function similar to that of the invention described in U.S. Pat. No. 3,732,856 hereinafter referred to as reference A. The invention described herein completely stops the flow of any gasoline to the engine during the delay time interval of engine cranking and in this way is an improvement over the invention described in reference A which latter only stops that flow of gasoline to the engine, during the delay time interval, which is caused by the action of the choke device.

Different kinds of valves, actuators, and timers can be used and in various differing combinations. The valve element can be any one of several different types including slider valves, spool valves, gate valves, globe valves, swing valves, etc., providing only that the valve can fully stop the flow of gasoline to the engine and can fully open the flow of gasoline to the engine. A solenoid acting on a magnetic portion of the valve can be used as a valve actuator element. A bimetallic thermostat element, heated by battery current during cranking, can be used as a delay timer component by acting, when sufficiently heated, upon switches to de-energize valve closer solenoids or to energize valve opener solenoids.

Figure 2:
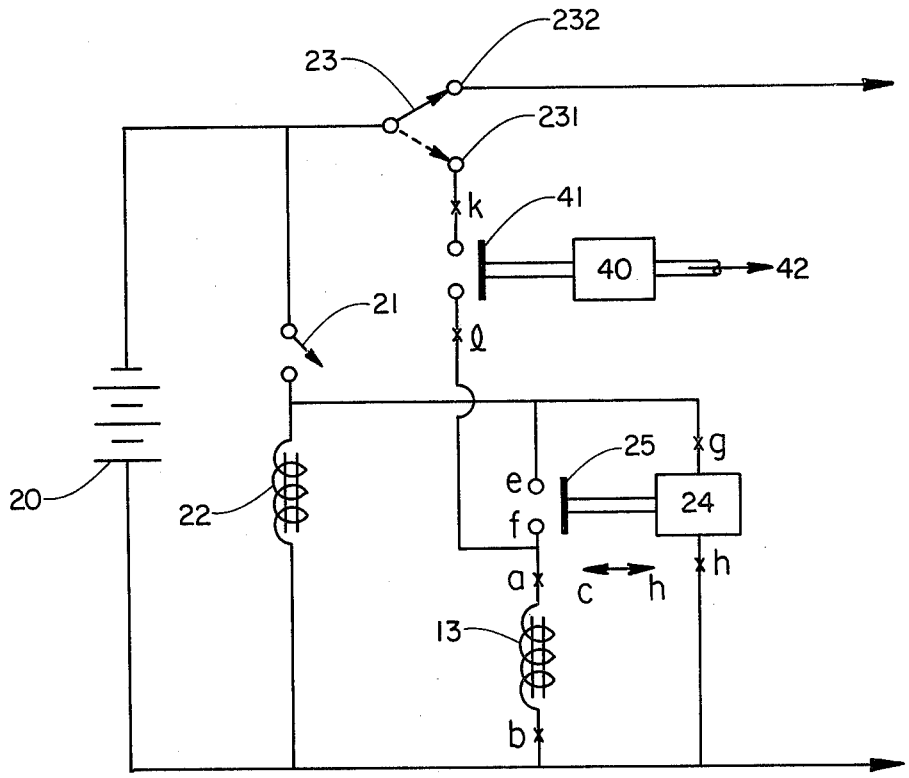
FIG. 2 shows one form of electrical circuit for the energizing and de-energizing of the actuator solenoid, 13, utilizing the battery, 20, starter switch, 21, starter solenoid, 22, and ignition switch, 23, of the usual gasoline engine electric starting and ignition system together with the lubricating oil pressure actuated switch, 40, and the thermostatic solenoid releaser switch, 24.
Figure 3:
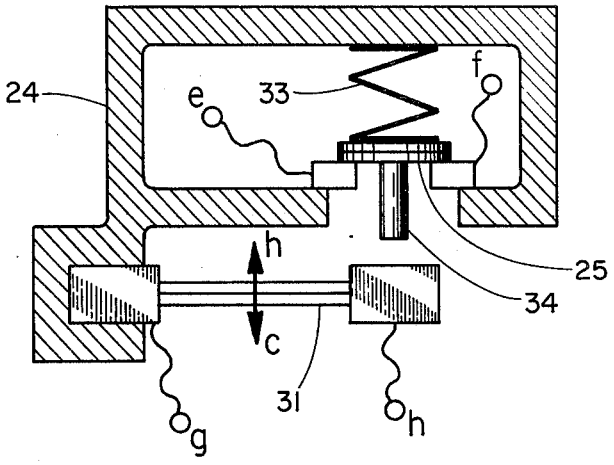
FIG. 3 shows a cross sectional view of one form of thermostatic solenoid releaser switch, 24, including the switchbar, 25, and the electrically heated bimetallic element, 31.
Figure 4:
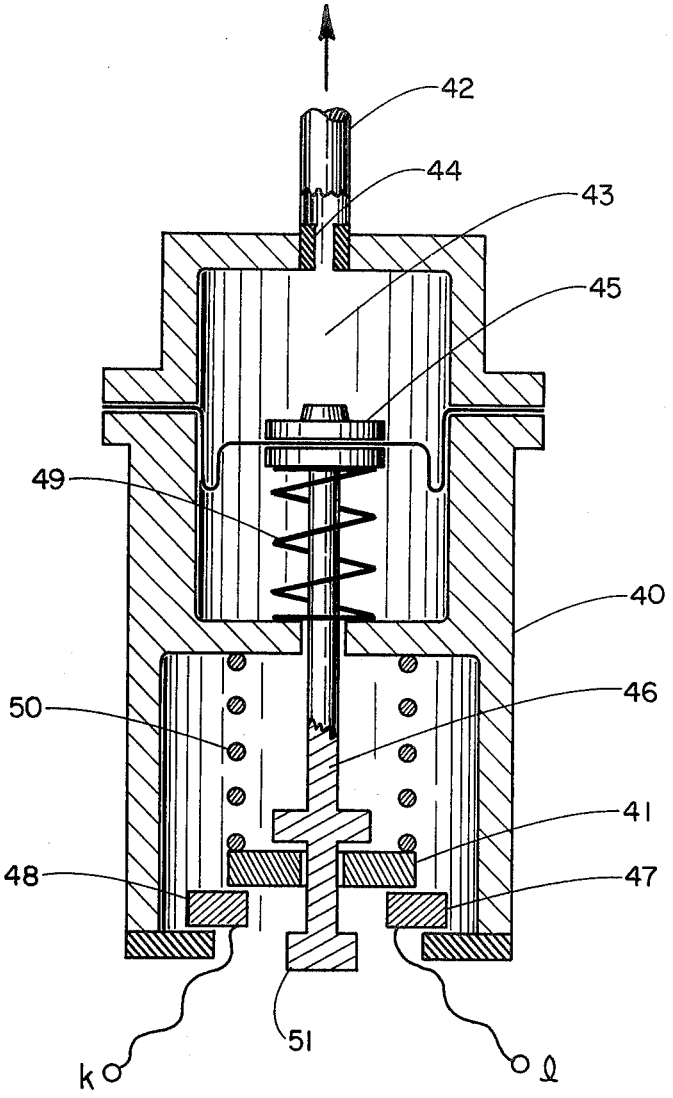
FIG. 4 is a cross sectional view of one form of lubricating oil pressure actuated switch, 40, including the oil pressure switchbar, 41, and the connection, 42, to the engine lubricating oil pressure supply system.

A preferred form of this invention is shown in FIGS. 1, 2, 3 and 4 and contains; a valve element, 11; a valve actuator comprising a magnetic element, 12, made of a magnetic material such as iron or mild steel and connected to the valve, 11; a solenoid, 13, which closes the valve, 11, when energized; and a hold-open spring, 14, which latter acts to open the valve, 11. Gasoline from the carburetor fuel metering device flows to the valve, 11, via the passage, 15, and flows from the valve to the fuel delivery jet via the passage, 16. The solenoid, 13, is energized by the battery via the circuit shown in FIG. 2 comprising the battery, 20, the typical engine starter switch, 21, the typical engine starter solenoid, 22, to actuate the usual electric starting motor switch, the actuator solenoid, 13, the modified engine ignition switch, 23, a thermostatic solenoid releaser switch, 24, and switchbar, 25, and a lubricating oil pressure actuated switch, 40, and switchbar, 41. A thermostatic solenoid releaser switch, 24, is shown in detail in FIG. 3, and consists of an electrically heated bimetallic strip, 31, which moves in the direction, *h*, when heated and in the direction, *c*, when cooled, a switchbar, 25, which is opened against the spring, 33, when the bimetallic strip, 31, becomes sufficiently deflected in the heated direction to contact the insulated bar, 34, and whose switch terminals *e* and *f* connect into the circuit of the solenoid, 13, as shown in FIG. 2. The bimetallic strip, 31, is electrically heated when battery current passes through the connection point *h*, the bimetallic strip heater, 31, the connection point *g* and the engine starter switch, 21, as shown in FIG. 2. The quantity of battery current passing through the heater of the bimetallic strip, 31, is preset by design of the electrical resistance of the heater. The switchbar, 25, is insulated as necessary from the bimetallic strip and the spring, 33. A lubricating oil pressure actuated switch, 40, is shown in detail in FIG. 4 and consists of; a sealed chamber, 43, connecting via the flow passage, 42, to the pressure side of the engine lubricating oil pump; a flow restriction, 44, in the flow passage, 42; a flexible diaphragm piston, 45, fastened to the switchbar actuator rod, 46; the switchbar, 41, which closes across the contacts, 47 and 48, which latter connect into the circuit of FIG. 2 via the connections, *k* and *l*; a piston return spring, 49, whose force acts to push oil out of the chamber, 43, a switchbar closing spring, 50, whose force acts to close the switchbar, 41, across the contacts, 47 and 48. The housing of the lubricating oil pressure actuated switch, 40, and the switchbar actuator rod, 46, are electrically insulated as necessary so that electrical contact between terminals 47 and 48 can only be made via the switchbar, 41. The modified engine ignition switch, 23, is similar to a typical engine ignition switch except that an ignition off contactor, 231, is provided, in addition to the usual ignition on contactor, 232, so that battery current may continue to energize the solenoid, 13, whenever the ignition is turned off and the lubricating oil pressure actuated switch, 40, is closed.

When a cold gasoline engine is to be started the ignition switch, 23, is turned to the ignition on contactor, 232 and the starter switch, 21, is manually closed, energizing the starter solenoid, 22, and hence the engine starting electric motor, and the solenoid, 13, the thermostatic solenoid releaser switch, 24, being closed since the bimetallic strip is cold at the beginning. Hence the valve, 11, is at first automatically held closed and no gasoline flows to the engine while the engine is initially cranked by the electric starting motor. As the engine is cranking, a heating electric current is passing through the heater of the bimetallic strip, 31, and the consequent temperature rise causes the bimetallic strip to move in the direction *h*. Eventually the bimetallic strip, 31, will open the switchbar, 25, and deenergize the solenoid, 13, causing the spring, 14, to fully open the valve, 11. Since gasoline now flows to the engine it may start firing and subsequently warm up fully. When the engine starts firing, the starter switch, 21, is opened and thereafter the starter solenoid, 22, the solenoid, 13, and the bimetallic strip heater, 31, will no longer have battery current flowing through them and the valve, 11, will remain open. The delay time interval during which the valve, 11, is held closed by the solenoid, 13, increases as the ambient air temperature decreases since the bimetallic strip, 31, starts initially further deflected in the cold direction, *c*. The desired delay time interval characteristics of the thermostatic solenoid releaser switch, 24, can be adapted to the requirements of any particular gasoline engine by a proper selection of the kind and geometry of the metals in the bimetallic strip, 31, the gap between the bimetallic strip and the button of the contactor switch, 34, and the stiffness of the hold closed spring, 33, of the contactor switch. In some cases it may be desirable to interpose a current reducing resistor in series with the bimetallic strip heater in order to modify the delay time interval characteristics of the thermostatic solenoid releaser switch.

As the gasoline engine starts and runs, the lubricating oil pump in the engine builds up a high lubricating oil supply pressure and this pressure, acting via the connection, 42, inside the chamber, 43, of the lubricating oil pressure actuated switch, 40, forces the diaphragm piston, 45, against the contrary force of the piston return spring, 49, in a direction to close the switchbar, 41, across the contacts, 47 and 48. Hence the lubricating oil pressure actuated switch, 40, is closed while the gasoline engine is running.

When a running gasoline engine is to be stopped the ignition switch, 23, is turned to the ignition off contactor, 231, and the solenoid, 13, is energized via the now closed lubricating oil pressure actuated switch, 40. Hence the valve, 11, is closed and gasoline cannot flow to the engine which thus stops promptly even when a source of non-spark ignition exists inside the engine combustion chamber. After the engine stops running the lubricating oil supply pressure drops to atmospheric since the oil pump stops. The lubricating oil within the chamber, 43, gradually flows out via the restriction, 44, and the passage, 42, into the oil sump via the engine oil pressure supply system, under the action of the force of the piston return spring, 49. Thus the diaphragm piston, 45, and the connected switchbar actuator rod, 46, are gradually moved in a direction so that the shoulder, 51, will lift the switchbar, 41, off of the contacts, 47 and 48, and the lubricating oil pressure actuated switch, 40, will become open a short time interval after the engine has stopped. In this way the solenoid, 13, is deenergized a short time interval after the engine has stopped and battery current is thus prevented from flowing through the solenoid, 13, during all the time that the engine is stopped.

The piston and flexible diaphragm elements, shown in the sketches are intended to include the mechanical components and configuration as sketched and also the equivalent elements made up of metallic bellows or alternatively made up of pistons and cylinders, all such configurations being referred to in the claims of this invention as piston and cylinder elements.

The electric circuit shown in FIG. 2 contains a single pole starter switch and associated starter solenoid wiring but it is not intended to limit the use of this invention to this starter switch arrangement. In the various electric circuits shown no particular ground connections or battery polarity are shown in order not to limit the invention to any particular grounding or polarity arrangement. It is common practice today to ground one side of the battery in many gasoline engine applications but practice varies as to whether the positive or negative side of the battery is grounded. The various electric circuits of my invention will function equally well with any particular arrangement of battery polarity and grounding which remains functional for the other electrical circuits of the engine.

A bimetallic strip is shown as the thermostatic element in the description and sketches of the preferred embodiment of this invention but it is not intended to limit the invention to this one kind of thermostatic element, since other mechanically responding thermostatic elements, such as sealed liquid expansion or sealed gas expansion thermostatic elements, could also be used, in lieu of the bimetallic strip thermostatic element, to accomplish the beneficial objects of this invention.

I claim:

1. The combination of a conventional gasoline engine wherein the improvement comprises; modifying the usual ignition switch by adding an ignition off contactor thereto, said contactor connecting to the battery when the usual ignition switch is turned off; and interposing, in the fuel flow channel between the fuel metering device and the fuel delivery jet of the gasoline metering system of said gasoline engine, the valve element of a gasoline engine fuel interrupter device comprising, said valve element, a valve actuator element, a delay timer component, and a lubricating oil pressure actuated switch;

said valve element, when closed blocking fully the fuel flow channel and when open opening fully the fuel flow channel, and being equipped with a magnetic portion;

said valve actuator element comprising; a solenoid, fixed to the engine frame, whose magnetic field when energized acts upon the magnetic portion of the valve element in a direction to close the valve, a valve spring whose force acts upon the valve in a direction to open the valve, the magnetic force exerted by the solenoid when energized being large enough to fully overcome the oppositely directed force of the valve spring and thus to close the valve, the force of the valve spring being large enough to fully open the valve when the solenoid is not energized; an electrical circuit for energizing the solenoid from the starting battery having two parallel solenoid energizing paths, one path being the engine starter switch, the switch portion of the delay timer component and the solenoid these two switches and the solenoid being connected in series, the other path being the ignition off contactor of the usual ignition switch, the switch portion of a lubricating oil pressure actuated switch and in series therewith the solenoid;

said delay timer component comprising a thermostatic element which deflects when its temperature changes, an electric heating element which heats the thermostatic element, an electrical heating circuit to supply electric current from the starting battery to said electric heating element, and a spring closed switch portion, said thermostatic element having one end fixed with the other end free to deflect and being positioned relative to said spring closed switch portion that it will open said spring closed switch portion when sufficiently deflected by the heating of the electric heating element, said electrical heating circuit connecting the electric heating element to the battery in series with the engine starter switch;

said lubricating oil pressure actuated switch comprising, a piston and cylinder element, a sealed volume one side of said piston which is acted upon by lubricating oil pressure via a restricted passage from the engine lubricating oil pressure supply system, a piston return spring acting upon the other side of said piston whose force is opposite to that created on the piston by the lubricating oil pressure, a switchbar actuator rod secured to said piston and acting upon the switch portion to close said switch portion when the piston is sufficiently moved by the lubricating oil pressure and to open said switch portion when the piston is sufficiently moved in the opposite direction by the piston return spring, and the switch portion of said lubricating oil pressure actuated switch.

2. The combination of a conventional gasoline engine wherein the improvement comprises interposing, in the fuel flow channel between the fuel metering device and the fuel delivery jet of the gasoline metering system of said gasoline engine, the valve element of a gasoline engine fuel interrupter device comprising said valve element, a valve actuator element, and a delay timer component;

said valve element, when closed blocking fully the fuel flow channel and when open opening fully the fuel flow channel, and being equipped with a magnetic portion;

said valve actuator element comprising; a solenoid, fixed to the engine frame, whose magnetic field when energized acts upon the magnetic portion of the valve element in a direction to close the valve, a valve spring whose force acts upon the valve in a direction to open the valve, the magnetic force exerted by the solenoid when energized being large enough to fully overcome the oppositely directed force of the valve spring and thus to close the valve, the force of the valve spring being large enough to fully open the valve when the solenoid is not energized; an electrical circuit for energizing the solenoid from the starting battery through the engine starter switch, the switch portion of the delay timer component and the solenoid these two switches and the solenoid being connected in series;

said delay timer component comprising a thermostatic element which deflects when its temperature changes, an electric heating element which heats the thermostatic element, an electrical heating circuit to supply electric current from the starting battery to said electric heating element, and a spring closed switch portion, said thermostatic element having one end fixed with the other end free to deflect and being positioned relative to said spring closed switch portion that it will open said spring closed switch portion when sufficiently deflected by the heating of the electric heating element, said electrical heating circuit connecting the electric heating element to the battery in series with the engine starter switch.

3. The combination of a conventional gasoline engine wherein the improvement comprises modifying the ignition switch by adding an ignition off contactor thereto and interposing between the fuel metering device and the fuel delivery jet of the gasoline metering system of said gasoline engine the valve portion of a gasoline engine fuel interrupter device comprising said valve portion, a valve actuator portion, a delay timer component, and a lubricating oil pressure actuated switch;

said valve portion being positioned in the fuel flow channel of the gasoline metering system so that fuel flow to the engine is stopped when the valve is closed and the fuel may flow readily to the engine when the valve is open;

said valve actuator being a solenoid acting on a magnetic portion of the valve to close the valve when the solenoid is energized, and a valve spring acting to open the valve, said solenoid being energized by battery current via the engine starter switch and, in series therewith, the switch portion of a thermostatic releaser switch, said solenoid being additionally energized by battery current via the ignition off contactor of the ignition switch and the switch portion of a lubricating oil pressure actuated switch in series therewith;

said delay timer component being the thermostatic element in the thermostatic releaser switch, heated by battery current via the engine starter switch, said thermostat element being so positioned that it mechanically opens the thermostatic releaser switch after being sufficiently heated by said battery current and is thus sufficiently deflected as to open said switch, such opening of said switch causing deenergizing of the solenoid and opening of the valve by the valve spring, the required time of heating of the thermostat element to said opening of said releaser switch, and thus the delay time interval of engine cranking during which the valve remains closed, being longer as the ambient temperature and thus the beginning temperature of the thermostat element becomes lower;

said lubricating oil pressure actuated switch comprising, a piston and cylinder element, a sealed volume on one side of said piston which is acted upon by lubricating oil pressure via a restricted passage from the engine lubricating oil pressure supply system, a piston return spring acting upon the other side of said piston with a force opposite to that created on the piston by the lubricating oil pressure, a switchbar actuator rod secured to said piston and acting upon the switch portion to close said switch portion when the piston is sufficiently moved by the lubricating oil pressure and to open said switch portion when the piston is sufficiently moved in the opposite direction by the piston return spring, and the switch portion of said lubricating oil pressure actuated switch.

4. The combination of a conventional gasoline engine wherein the improvement comprises interposing between the fuel metering device and the fuel delivery jet of the gasoline metering system of said gasoline engine the valve portion of a gasoline engine fuel interrupter device comprising said valve portion, a valve actuator portion, and a delay timer component;

said valve portion being positioned in the fuel flow channel of the gasoline metering system so that fuel flow to the engine is stopped when the valve is closed and the fuel may flow readily to the engine when the valve is open;

said actuator being a solenoid acting on a magnetic portion of the valve to close the valve when the solenoid is energized, and a valve spring acting to open the valve, said solenoid being energized by battery current via the engine starter switch and, in series therewith, the switch portion of a thermostatic releaser switch;

said delay timer component being the thermostatic element in the thermostatic releaser switch, heated by battery current via the engine starter switch, said thermostat element being so positioned that it mechanically opens the thermostatic releaser switch after being sufficiently heated by said battery current and is thus sufficiently deflected as to open said switch, such opening of said switch causing deenergizing of the solenoid and opening of the valve by the valve spring, the required time of heating of the thermostat element to said opening of said releaser switch, and thus the delay time interval of engine cranking during which the valve remains closed, being longer as the ambient temperature and thus the beginning temperature of the thermostat element becomes lower.

* * * * *